US008684283B2

(12) United States Patent
Nies et al.

(10) Patent No.: US 8,684,283 B2
(45) Date of Patent: Apr. 1, 2014

(54) VARIABLE RANGE SPRINKLER APPARATUS AND VARIABLE RANGE SPRINKLER PATTERN METHOD

(75) Inventors: Juergen Nies, Winchester, VA (US); Ha Van Duong, Winchester, VA (US); Vicky Ann Michael, Winchester, VA (US)

(73) Assignee: Melnor, Inc., Winchester, VA (US)

( * ) Notice: Subject to any disclaimer, the term of this patent is extended or adjusted under 35 U.S.C. 154(b) by 1008 days.

(21) Appl. No.: 12/769,451

(22) Filed: Apr. 28, 2010

(65) Prior Publication Data

US 2010/0276512 A1 Nov. 4, 2010

Related U.S. Application Data

(60) Provisional application No. 61/174,844, filed on May 1, 2009.

(51) Int. Cl.
*B05B 17/04* (2006.01)
*B05B 3/04* (2006.01)

(52) U.S. Cl.
USPC ..... 239/11; 239/97; 239/237; 239/240; 239/273; 239/562; 239/DIG. 1; 239/569; 239/581.1

(58) Field of Classification Search
USPC ..... 239/97, 101, 203–206, 237, 240, 263, 239/273, 275, 276, 285, 562, 569, 580, 239/DIG. 1, 1, 11, 581.1
See application file for complete search history.

(56) References Cited

U.S. PATENT DOCUMENTS

| | | | | |
|---|---|---|---|---|
| 2,190,639 | A * | 2/1940 | Wittek | 239/DIG. 1 |
| 2,376,007 | A | 5/1945 | Quigley | |
| 2,596,577 | A | 5/1952 | McBride | |
| 2,729,504 | A | 1/1956 | Zukas | |
| 2,739,839 | A * | 3/1956 | Greener et al. | 239/97 |
| 2,767,021 | A | 10/1956 | Nelson | |
| 2,884,202 | A | 4/1959 | Smith | |
| 3,104,818 | A | 9/1963 | Ballard et al. | |
| 3,231,199 | A | 1/1966 | Mattson | |
| 3,391,868 | A | 7/1968 | Cooney | |
| 4,540,125 | A | 9/1985 | Gorney et al. | |
| 4,625,914 | A | 12/1986 | Sexton et al. | |
| 4,809,910 | A | 3/1989 | Meyer | |
| 4,819,875 | A | 4/1989 | Beal | |
| 4,892,252 | A | 1/1990 | Bruninga | |
| 4,905,903 | A | 3/1990 | Katzer et al. | |
| 5,526,982 | A | 6/1996 | McKenzie | |
| 5,598,977 | A | 2/1997 | Lemme | |
| 5,746,374 | A | 5/1998 | Simonetti et al. | |
| 5,769,322 | A | 6/1998 | Smith | |
| 6,336,596 | B1 | 1/2002 | Katzman et al. | |
| 6,547,166 | B1 | 4/2003 | Heren | |
| 6,732,950 | B2 | 5/2004 | Ingham, Jr. et al. | |
| 6,929,194 | B2 | 8/2005 | Lawson | |

(Continued)

*Primary Examiner* — Steven J Ganey
(74) *Attorney, Agent, or Firm* — Westerman, Hattori, Daniels & Adrian, LLP

(57) ABSTRACT

A variable range sprinkler apparatus includes a sprinkler portion, a bypass unit housing a plurality of valves, and a water inlet portion. The sprinkler portion of the apparatus, which may be a rotary sprinkler unit, is attached to the bypass unit, and the bypass unit is coupled to the water inlet portion. Inside the bypass unit is a plurality of valves, at least one of which is adjustable, that are designed to open a water passage in the bypass unit.

19 Claims, 16 Drawing Sheets

(56) References Cited

U.S. PATENT DOCUMENTS

| | | | |
|---|---|---|---|
| 7,017,831 | B2 | 3/2006 | Santiago et al. |
| 7,232,078 | B2 | 6/2007 | Kah, Jr. |
| 7,416,139 | B2 | 8/2008 | Kah, Jr. |
| 2005/0194464 | A1 | 9/2005 | Bruninga |
| 2008/0290190 | A1 | 11/2008 | Kah, Jr. |

* cited by examiner

VARIABLE RANGE SPRINKLER APPARATUS AND VARIABLE RANGE SPRINKLER PATTERN METHOD

BACKGROUND OF THE INVENTION

The present disclosure relates to adjustable sprinklers used for irrigation and, more particularly, to a rotary sprinkler (above or below ground) which changes the rate of water flow to attain a predetermined irrigation pattern.

There are various types of sprinkler systems using different types of sprinklers (e.g., pulsating, rotary, oscillating, traveling, etc.) for irrigating lawns, farms, etc. Some systems include in-ground pop-up type sprinklers and others include portable type sprinklers that can be attached to a conventional garden hose.

Conventional rotary sprinklers (both pop-up and portable) typically spray water in a 360° pattern from the tip of a spray arm (or multiple spray arms) that spins as the sprinkler waters the lawn. These sprinklers may also be partially adjusted (electronically or mechanically) to rotate such that only a segment (e.g., 90 degree, 270 degree, etc.) of a circular path is watered. One example of such a sprinkler being mechanically adjustable is disclosed in U.S. Pat. No. 4,892,252. This design, however, can not be effectively deliver water in a complex watering pattern (e.g., desirable for non-circular areas to be watered).

Due to limited adjustability, such conventional rotary sprinklers waste water (e.g., resulting in higher water bills and potential local ordinance violations) due to over-spraying non-circular areas.

SUMMARY OF THE INVENTION

One aspect of the invention includes a variable range sprinkler apparatus having a sprinkler portion, a bypass unit housing a plurality of valves (2-8, preferably 6), and a water inlet portion. The sprinkler portion of the apparatus, which may be a rotary sprinkler unit, is attached to the bypass unit, and the bypass unit is coupled to the water inlet portion. Inside the bypass unit is a plurality of valves, at least one of which is adjustable, that are designed to open a water passage in the bypass unit.

The apparatus may use a plurality of ball valve, each designed with a water passage for directing water through the bypass unit.

The apparatus may also include a rotatable water outlet unit or assembly arranged inside the bypass unit that accommodates a main axle extending downward from the rotary sprinkler portion of the apparatus to the water inlet portion of the apparatus.

The bypass unit may be a single unit or an assembly of an upper housing that is rotatably attached to the sprinkler portion, a lower housing that is coupled to the upper housing, and a base plate that is coupled to the lower housing and the water inlet portion of the apparatus.

The bypass unit may be designed to house a plurality of valve chambers that are arranged in a ring-like fashion, wherein each of the chambers accommodates a valve.

In order to enable a user to easily adjust the valve(s) located inside the apparatus, the apparatus may include a valve adjustment unit (or knob) coupled to a valve and located outside of the bypass unit.

According to one aspect of this invention, the apparatus is equipped with a main axle that is designed to direct water in and out of the bypass unit at desired locations.

According to one aspect of this invention, the rotatable water outlet unit includes a top outlet unit having a first portion extending from a second portion thereof, and a water outlet plate positioned inside the second portion of the top outlet unit. The first portion may have a smaller outside diameter than the second portion. The main axle may extend through a center portion of the water outlet unit, both top outlet unit and water outlet plate. An outside diameter of the water outlet plate may be substantially equal to an inside diameter of the second portion of the top outlet unit.

According to one aspect of this invention, the water outlet may include a plate portion, a protrusion extending upward from a top surface of the plate portion, and a cutout portion formed through the plate portion. A height of the protrusion may be substantially equal to a depth of the second portion of the top outlet unit. The cutout portion may be configured to align with a water passageway outlet of a valve as the water outlet unit rotates. The width of the cutout portion may be formed greater than or equal to a sum of A and B, wherein A is a diameter of the water passageway outlet, and B is a minimum distance between adjacent water passageway outlets.

To provide further rigidity, the water outlet plate may include a support ridge extending upward from a top surface thereof.

According to one aspect of this invention, the water outlet may include a plurality of protrusions spaced apart in a ring-like manner, wherein a passageway is defined by adjacent protrusions. The passageway may communicate water from the bypass unit to a water outlet aperture of the main axle.

According to one aspect of this invention, the apparatus includes a generally cylindrical sleeve located between an inside surface of the bypass unit and an outside surface of a large diameter portion of the water outlet unit. The sleeve may be attached to an inside surface of the bypass unit and may function as a water seal for the water outlet unit and it may also function to reduce friction that may be generated between the rotating water unit and the bypass unit.

Another aspect of this invention includes a unit for selectively bypassing water. The unit includes a housing, a plurality of valve chambers positioned inside the housing, and a plurality of valve assembly units. The plurality of valve chambers is arranged in a ring-like fashion and the valve assembly units are individually positioned inside the plurality of valve chambers. At least one of the valve assembly units is adjustable and at least one of the adjustable valve assembly units includes a valve coupled to an adjustment unit. Each of the adjustment unit adjusts the position of the valve it is coupled to.

Another aspect of this invention involves a method for adjusting water to flow through a sprinkler apparatus. The method involves adjusting a first valve of the apparatus to a first position and then adjusting a second valve of the apparatus to a second position. The valves are adjusted independently from one another. The first position influences a flow of the water exiting the sprinkler apparatus at a first time (T=1) and the second position influences the flow of the water exiting the sprinkler apparatus at a second time (T=1+n).

BRIEF DESCRIPTION OF DRAWINGS

The present disclosure is illustrated by way of example and not limited in the figures of the accompanying drawings in which like references indicate similar elements.

DETAILED DESCRIPTION OF THE DRAWINGS

Figure 1:
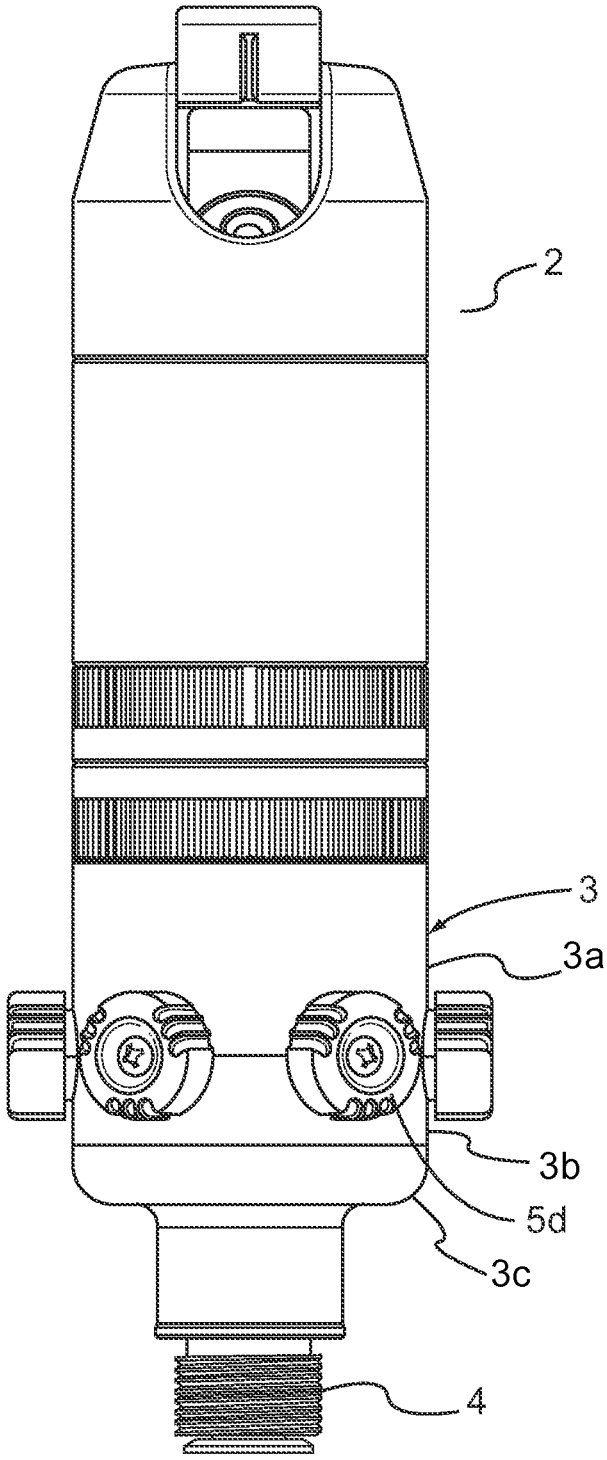
FIG. 1 shows a front view of a rotary sprinkler according to one embodiment.

All identically numbered reference characters correspond to each other so that a duplicative description of each reference character in the following drawings may be omitted.

Figure 11B:
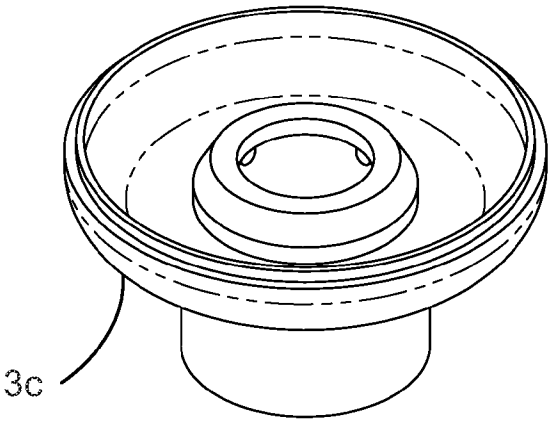
FIGS. 11*a-c* illustrates a top, perspective, and cross-section, respectively, of a bypass plate according to one embodiment.
Figure 11A:
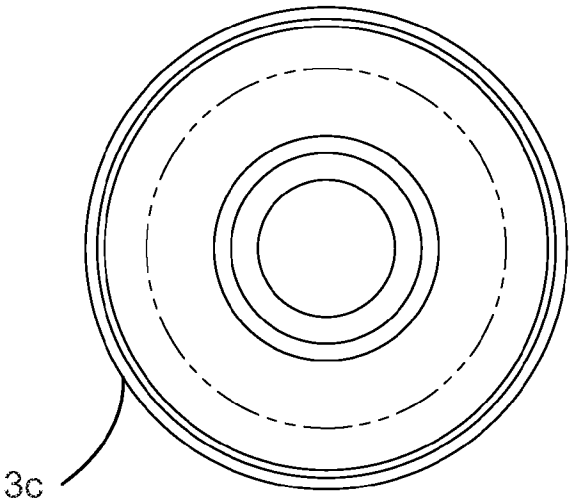
Figure 11C:
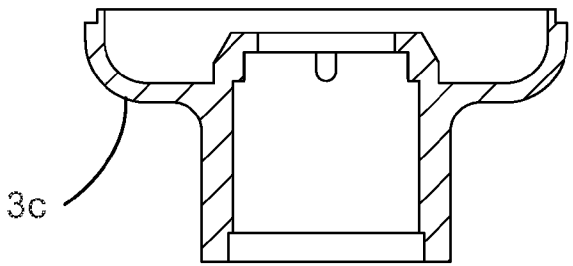
Figure 12A:
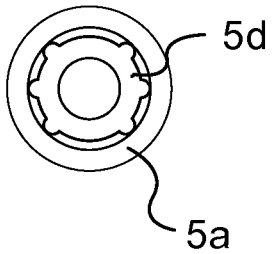
FIGS. 12*a-d* illustrates a top, perspective, elevation, and cross-section, respectively, of a ball valve subassembly according to one embodiment.
Figure 12B:
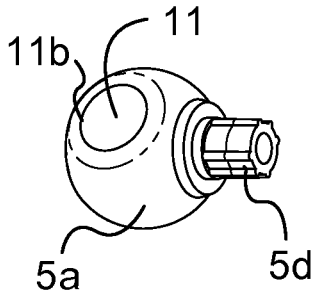
Figure 12C:
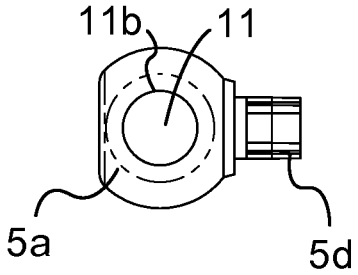
Figure 12D:
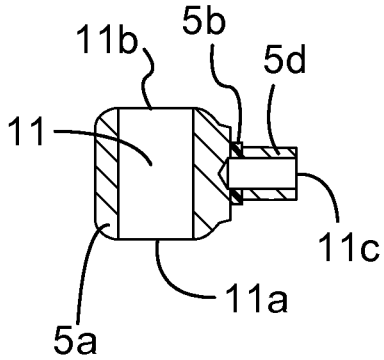

FIG. 1 shows a front view of one embodiment of a variable range rotary sprinkler apparatus 1 having a rotating sprinkler 2 (e.g., Melnor Model No. 2950 or any other suitable sprinkler) connected to a water bypass unit 3 that is connected to a water inlet 4. In this embodiment, the sprinkler is a rotary sprinkler (although apparatus 1 could incorporate a pulsating, pop-up, or other suitable type sprinkler) and water bypass unit 3 includes an upper bypass housing 3*a*, a lower bypass housing 3*b*, and a bypass plate 3*c* (top to bottom). FIGS. 9*a-d* illustrates a bottom, side, perspective, and cross-section, respectively, of one example of the upper bypass housing 3*a*. FIGS. 10*a-d* illustrates a bottom, side, perspective, and cross-section, respectively, of one example of the lower bypass housing 3*b*. FIGS. 11*a-c* illustrates a top, perspective, and cross-section, respectively, of one example of the bypass plate 3*c*. Not shown is a water supply source (e.g., hose) connected to water inlet 4 to communicate water through main axle 8 (described below) and bypass unit 3 to sprinkler 2. These components are preferably made of any suitable material, such as plastic, ABA or Delrin 500™.

Figure 2:
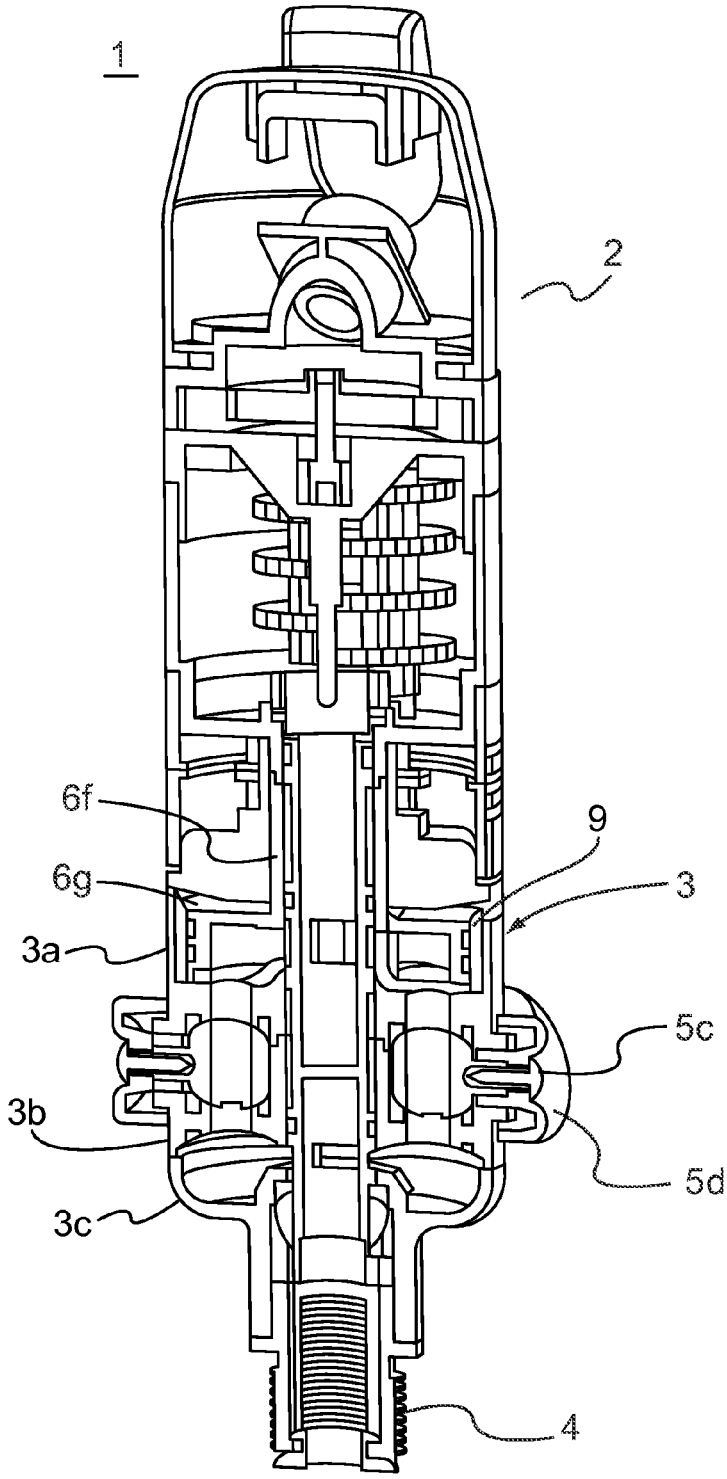
FIG. 2 shows a cross-section view of the sprinkler of FIG. 1.
Figure 15A:
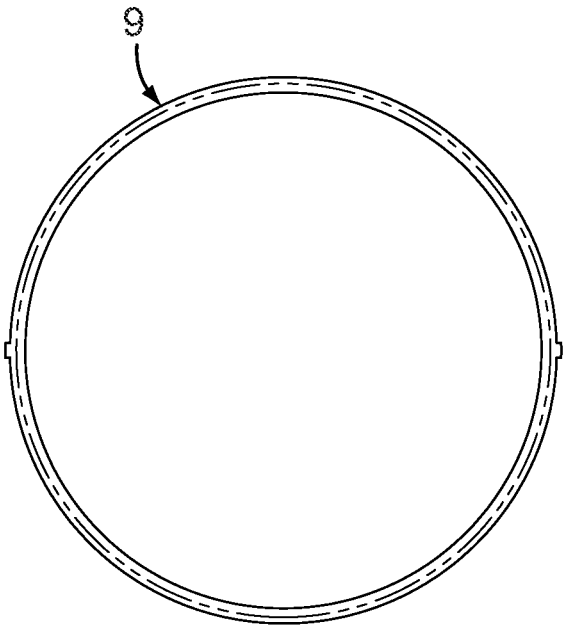
FIGS. 15*a-b* illustrates a top and cross-section, respectively, of a circular ring (sleeve) according to one embodiment.
Figure 15B:
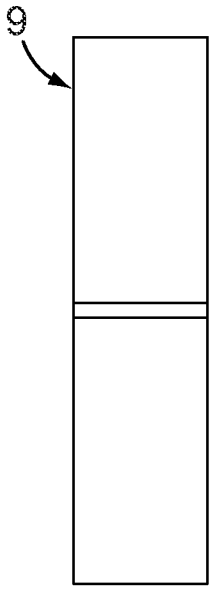

FIG. 2 (cross-section of FIG. 1) illustrates one embodiment of the present invention having a sleeve (e.g., cylindrical ring) 9 provided in a space between the upper bypass housing 3*a* and a large diameter portion of a generally cylindrical water outlet unit 6 (described below). As shown, the sleeve 9 is attached to an inside circumferential surface of the upper bypass housing 3*a*, for example, by a lock and key mechanism (other methods, such as snap, glue, and weld may also be used). The sleeve 9 is preferably made from a low friction or slippery-type material, such as Delrin 500™. The sleeve 9 is designed to improve sealing properties and reduce friction between the water outlet unit 6 and the upper bypass housing 3*a*. One or more o-rings (not shown) may also be sandwiched between the sleeve 9 and water outlet unit 6 to improve the water seal. FIGS. 15*a-b* illustrates a top and cross-section, respectively, of an example of a sleeve 9.

Figure 3:
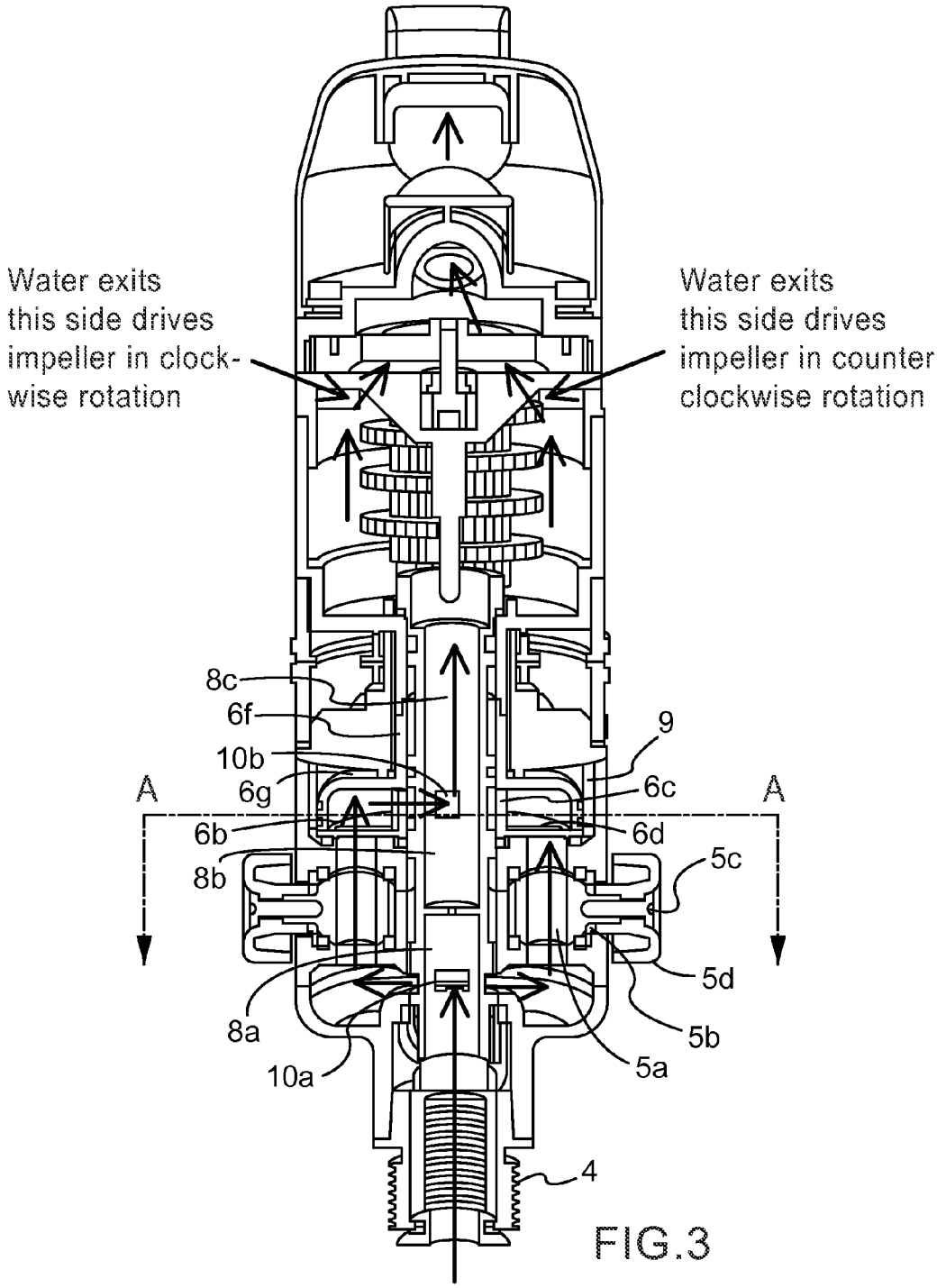
FIG. 3 shows a sectional view of the sprinkler, including water flow diagram, of FIG. 1.

FIG. 3 illustrates one example of a water flow path inside apparatus 1. As shown, water enters water inlet 4 (at the bottom of apparatus 1), flows into a bottom end of a water inlet portion 8*a* of a main axle 8, flows out of the main axle 8 and into the bypass base plate 3*c* of the bypass unit 3 via a water inlet aperture 10*a*. The water is then directed upward inside the bypass unit 3 through a water passageway 11 in ball valve 5*a* (e.g., valve 5*a* may be a ball valve, plate valve, or any other suitable valve) and into the water outlet aperture 10*b* of the water outlet portion 8*c* of the main axle 8, and then flows into an internal gear assembly of sprinkler 2 via the water outlet portion 8*c* and exits the apparatus 1. In this embodiment, the water passageway 11 is a through-hole traversing the ball valve 5*a* along the main axis of the apparatus 1. Although a ball valve 5*a* is used in this embodiment, it is known that the bypass unit 3 may be designed with other suitable type valve, such as a plate valve.

Figure 14B:
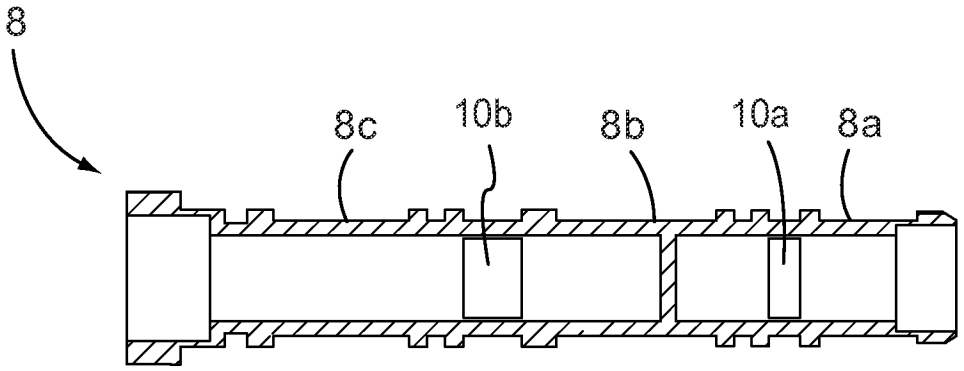
FIGS. 14*a-b* illustrate a top and cross-section, respectively, of a main axle according to one embodiment.
Figure 14A:
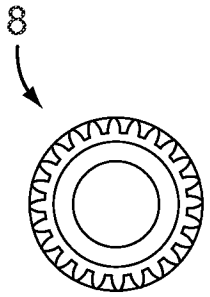

FIGS. 14*a-b* illustrates a top and cross-section view of an example of main axle 8.

Figure 4:
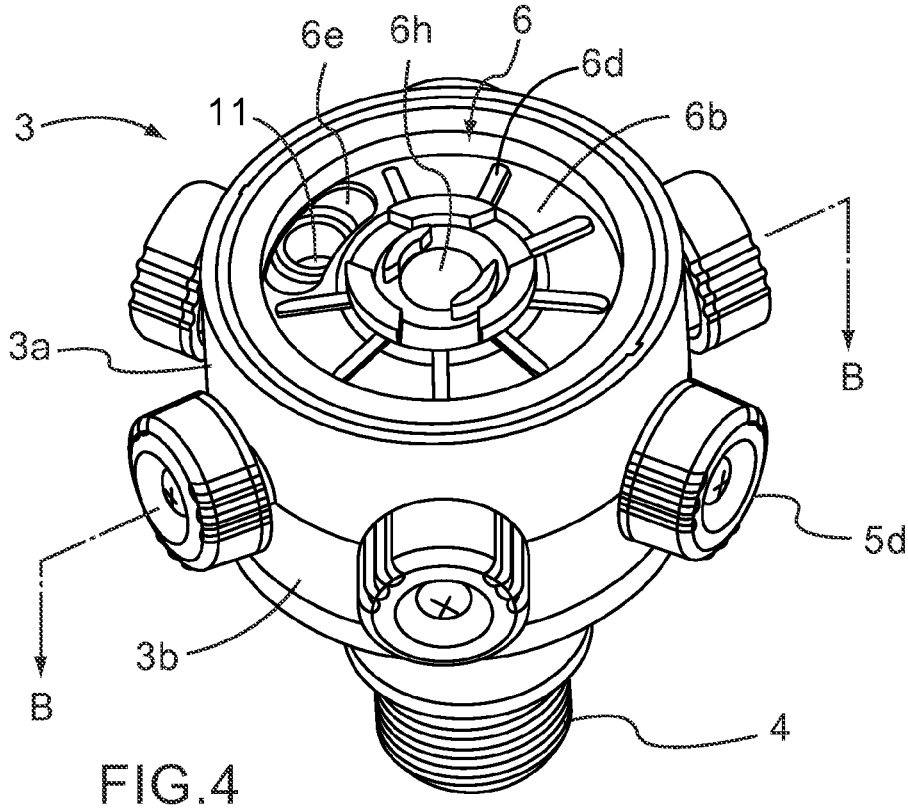
FIG. 4 shows a cross-section along the lines A-A of a portion of the sprinkler shown in FIG. 3.

Cross-section A-A of apparatus 1 is illustrated in FIG. 4 and described below.

Figure 5:
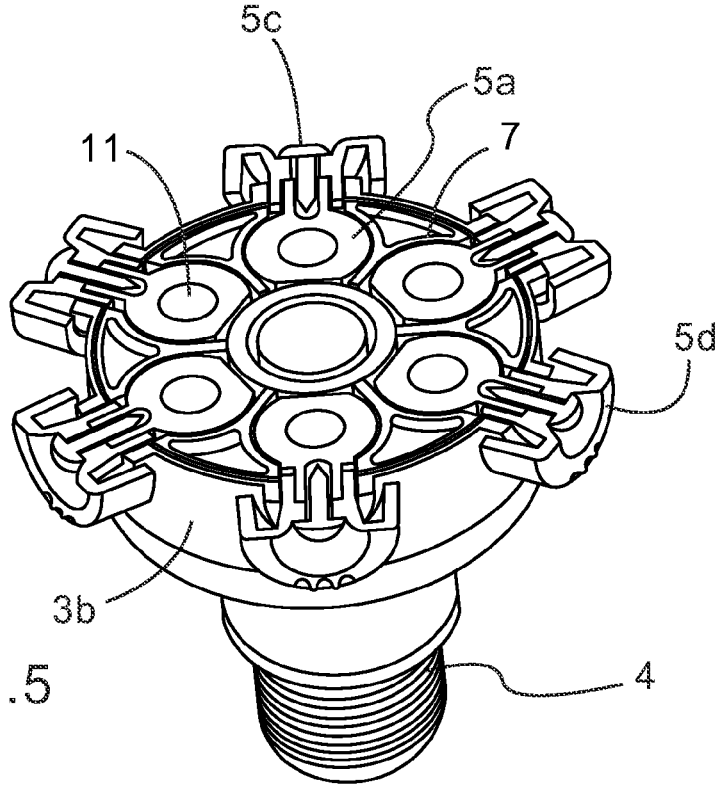
FIG. 5 shows a cross-section along the lines B-B of the portion of the sprinkler shown in FIG. 4.

FIG. 5 illustrates a cross-section along the lines B-B of the portion of the sprinkler shown in FIG. 4. The lower bypass housing 3*b* includes a plurality of chambers 7 (e.g., ball valve chambers) that are spaced equally apart and arranged in a ring-like fashion inside the housing 3*b*. The chambers 7 may be integral with the housing 3*b*. Each chamber 7 accommodates a ball valve 5*a* that is coupled to a valve adjustment unit 5*d* (e.g., switch, wheel, button), located outside the bypass unit 3, via a valve fastener 5*c* (e.g., screws, rivets). FIGS. 8*a-d* illustrate different the apparatus equipped with four different adjustment units 5*d*.

Figure 6:
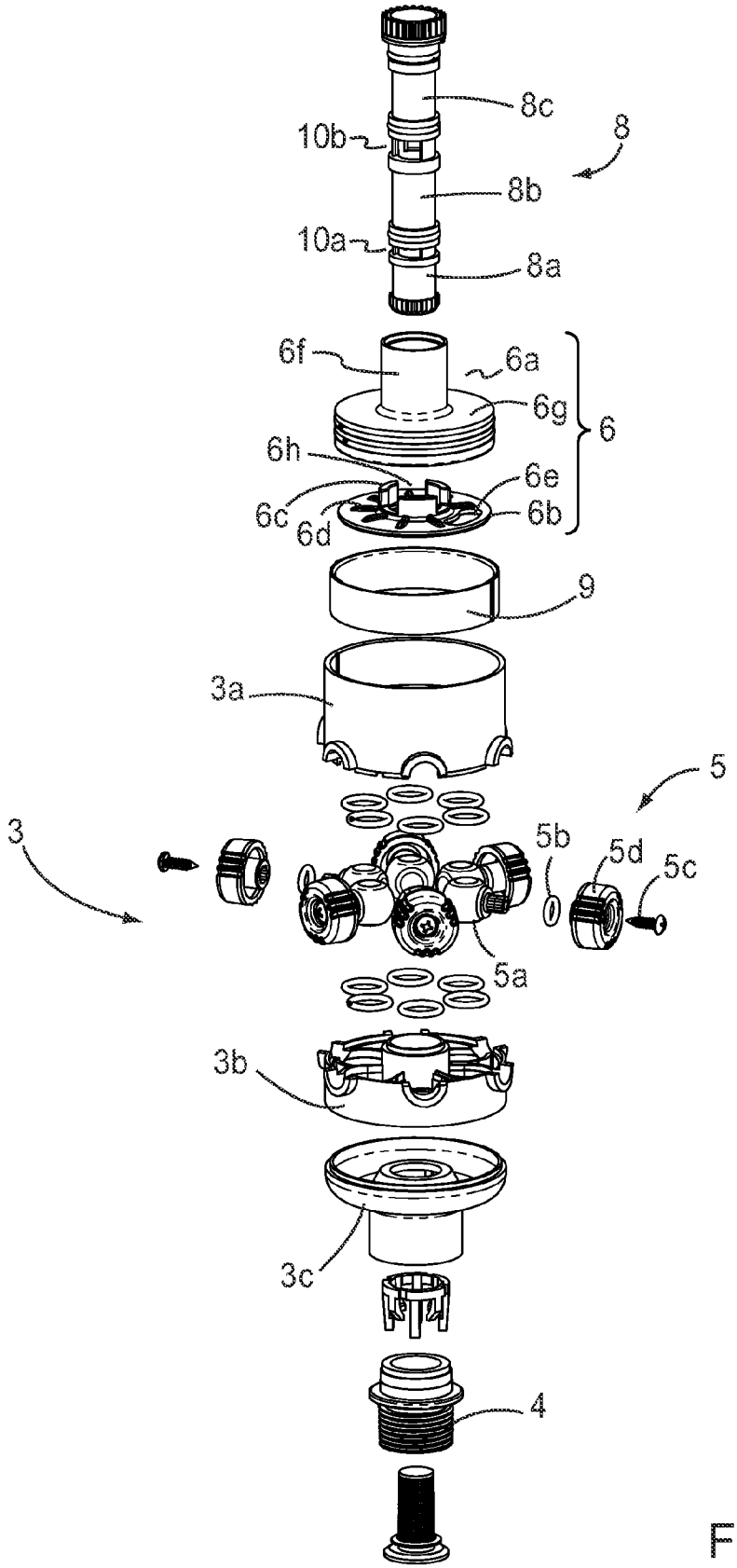
FIG. 6 shows an exploded assembly view of the sprinkler of FIG. 1.

FIG. 6 illustrates an exploded assembly view of one embodiment of a variable range rotary sprinkler apparatus 1 having the water bypass unit 3, which may be made from any suitable material, such as plastic, ABA or Delrin 500™.

In this embodiment, the water bypass unit 3 comprises upper bypass housing 3*a*, lower bypass housing 3*b*, and bypass base plate 3*c*. The water bypass unit 3 houses a water outlet unit 6 and a valve subassembly 5. As shown, the valve subassembly 5 comprises a plurality of ball valves 5*a*, a plurality of valve o-rings 5*b*, a plurality of valve fasteners 5*c*, and a plurality of valve adjustment units 5*d*. Each valve 5*a* is arranged in a valve chamber 7. FIGS. 12*a-d* illustrates a top, perspective, elevation, and cross-section, respectively, of the ball valve subassembly 5. As shown in FIG. 6, subassembly 5 includes six ball valves 5*a* (e.g., each ball valve is designed to control 60° of a 360° degree pattern) and six chambers 7.

Main axle 8 is generally cylindrical and extends upward from a radial center portion of the bypass base plate 3*c* to a radial center portion of the sprinkler 2. The main axle 8 comprises water inlet portion 8*a* in communication with a water source (not shown), intermediate portion 8*b*, and water outlet portion 8*c* in communication with the sprinkler 2, arranged from bottom to top of apparatus 1. The water inlet portion 8*a* is hollow and comprises one or more water inlet apertures 10*a* formed on an outer circumference thereof, wherein the water inlet apertures are arranged inside bypass unit 3. The water inlet apertures 10 may be arranged at a portion of the main axle adjacent to the bypass base plate 3*c* (below the ball valve subassembly 5). The intermediate portion 8*b* is solid (no passageway) and is designed to redirect the incoming supply of water out of the water inlet aperture 10*a* and into the bypass unit 3. In this embodiment, the intermediate portion 8*b* is arranged entirely within the bypass unit 3. The water outlet portion 8*c* is hollow and comprises one or more water outlet apertures 10*b* formed on an outer circumference thereof, wherein the water outlet apertures 10*b* are arranged inside bypass unit 3. Main axle 8 is designed such that supply water enters the inside of the bypass unit 3 via the water inlet portion 8*a* and exits the bypass unit 3 and enters the rotating sprinkler 2 via the water outlet portion 8*c*.

The adjustable ball valves 5*a*, preferably six, are arranged in a ring-like fashion along an outer shell of bypass unit 3. FIG. 6 illustrates a subassembly 5 having six ball valves 5*a*, wherein each of the ball valves 5*a* are spaced apart and substantially equidistant from one another. Although six valves are shown, more or less may be incorporated into water bypass unit 3. Each of the ball valves 5*a* is individually connected to a ball valve adjustment unit 5*d* (examples of different units that may be used are shown in FIGS. 8*a-d*) via a fastener 5*c* (screw, bolt, rivet). FIG. 6 illustrates an apparatus 1 equipped with a knob (adjustment unit 5*d*) communicating with an outside surface of the ball valve 5*a* via a ball valve screw (fastener 5*c*).

Each adjustment unit 5*d* communicates with an opening 7 formed in an outside cylindrical surface of the bypass unit 3. According to one aspect of the present invention, a top half of each opening 7 is formed in a lower portion of the upper bypass housing 3*a* and a bottom half of each opening is formed in an upper portion of the lower bypass housing 3*b* to form a complete opening. Ball valve o-rings 5*b* may be provided at each of the openings formed in the ball valve 5*a*, water passageway inlet 11*a*, water passageway outlet 11*b*, and fastener opening 11*c* to reduce water leakage potential. Three openings (11*a-c*) per ball valve equates to three o-rings per ball valve. Each of the ball valves 5*a* can be individually adjusted by the adjustment unit 5*d*, which is designed to be adjusted from outside of the bypass unit 3 to open or close the water passageway 11 in the ball valve 5*a* a desired amount. The water passageway 11 may be designed to open in a range that permits a suitable amount of water to operate sprinkler 2 (e.g., opening range of 10-100%, more preferably 50-100%, wherein 100% is fully open).

The bypass unit 3 illustrated in FIG. 5 comprises six chambers 7, wherein each chamber 7 houses a ball valve 5*a*. The chambers 7 (e.g., wall portions) may be integrally formed into the bypass unit 3 (e.g., top portion of chamber arranged in the upper bypass housing 3*a* and the bottom portion of the chamber arranged in the lower bypass housing 3*b*). The chambers are designed to isolate water in each chamber in order to prevent water from flowing into the other chambers during operation.

The ball valve subassembly 5 is designed to reduce or increase the desired flow rate of input water at each particular ball valve location. An operator individually adjusts one or more of the ball valves via the adjustment unit 5*d* to adjust the amount of water desired at a particular location. As shown in FIG. 3, water bypass unit 3 is designed so that water from inlet 4 is channeled through a water passageway 11 of one of the ball valves 5*a* before ultimately entering the gear assembly.

In the embodiment shown in FIG. 3, the bypass unit 3 does not rotate, only water outlet unit 6 (e.g., comprising water outlet plate 6*b* and top outlet unit 6*a*) rotates in order to align a cutout 6*e* of the water outlet plate 6*b* to an opening in one or more of the ball valves 5*a*.

Water outlet unit 6 may be a one-piece unit having a top plate section formed therein or a two-piece subassembly as shown in FIGS. 3 and 6 and described below.

Figure 13A:
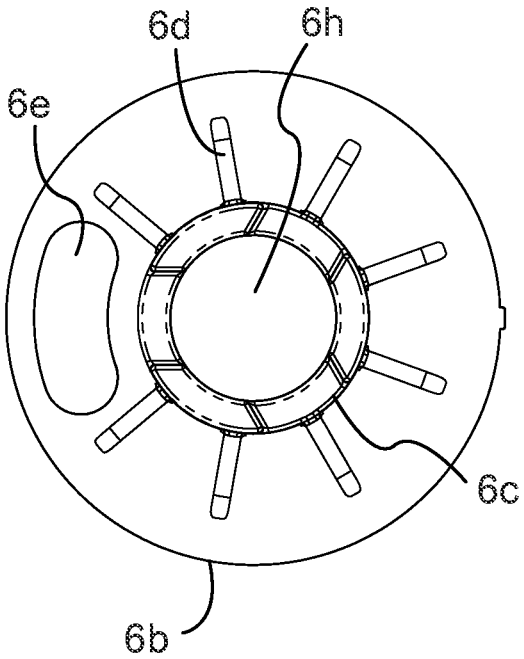
FIGS. 13*a-b* illustrates a top and cross-section, respectively, of a water outlet plate according to one embodiment.
Figure 13B:
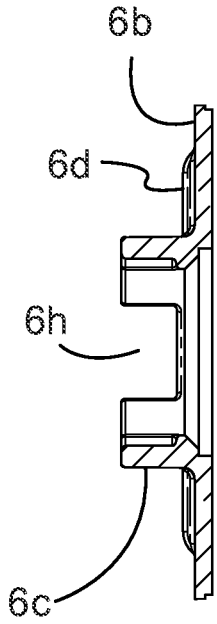

FIGS. 13*a* and 13*b* illustrate a top and cross-section, respectively, of one example of a one-piece water outlet plate 6.

FIG. 4 shows a cross-section along the lines A-A of a portion of the sprinkler shown in FIG. 3. The component parts are also shown in FIG. 6. According to the aspect shown in FIG. 4, the water outlet unit 6 comprises a water outlet plate 6*b* coupled to (e.g., snap fit, ultrasonically weld, glue, etc.) top outlet unit 6*a*. The water outlet unit 6*a* is adapted to receive main axle 8 through a center portion thereof. The top outlet unit 6*a* comprises a first portion 6*f* extending upward from a second portion 6*g*. According to the embodiment shown in FIG. 6, the diameter of the first portion 6*f* is less than the diameter of the second portion 6*g*.

The water outlet plate 6*b* may be formed, for example, from an ABS material or a friction reducing material (such as Delrin 500™). If the water outlet plate 6*b* is formed from Delrin 500™, then it is preferred that water outlet unit 6 be formed as a two piece subassembly in order to reduce material costs (e.g., Delrin 500™ can be used to form plate 6*b* and a less expensive material, such as ABS, can be used to form the top outlet unit 6*a*). Delrin 500™ is a low friction (slippery) material. Therefore, if the plate 6*b* is formed from this material, then the plate 6*b* can rotate without requiring much torque, even when applying pressure to the top of an o-ring (e.g., ball valve o-ring disposed on water passageway outlet 11*b*). However, if ball valve o-rings are not disposed on the water passageway outlets 11*b*, then the water outlet plate 6*b* may be formed from a standard ABS material (e.g., no friction problem).

As shown in FIGS. 13*a-b*, the water outlet plate 6*b* is circular and includes a plurality of protrusions 6*c* spaced apart in a ring-like manner and extending from a top surface thereof, a plurality of support ridges 6*d* extending from a top surface thereof, and a cutout portion 6*e* formed therein. The cutout portion 6*e* is located between the protrusions and the edge of the water outlet plate 6*b*. The protrusions are designed to provide rigidity to the outlet plate 6*b* and prevent the plate 6*b* from buckling due to opposing water forces. The space defined by adjacent protrusions forms a passageway 6*h* so that water can flow from the bypass unit 3 into the water outlet aperture 10*b* of the main axle 8.

According to one aspect of the disclosure, the height of the protrusion 6*c* is substantially equal to the depth of the second portion 6*g* (large diameter portion) of the top outlet unit 6*a*.

According to one aspect of the disclosure, the width of the cutout portion 6*e* should be equal to or greater than the diameter of one ball valve opening 11*b* and the distance between adjacent ball valve openings (e.g., valve 1 and the gap between valve 1 and valve 2). The shape and size of the cutout portion is designed so that, as the water outlet unit 6 rotates, the cutout portion 6*e* aligns with at least one of the ball valve 5*a* water passageway openings 11. The cutout's width is designed so that it would start to open the next hole as soon as it begins closing the current one.

Figure 7:
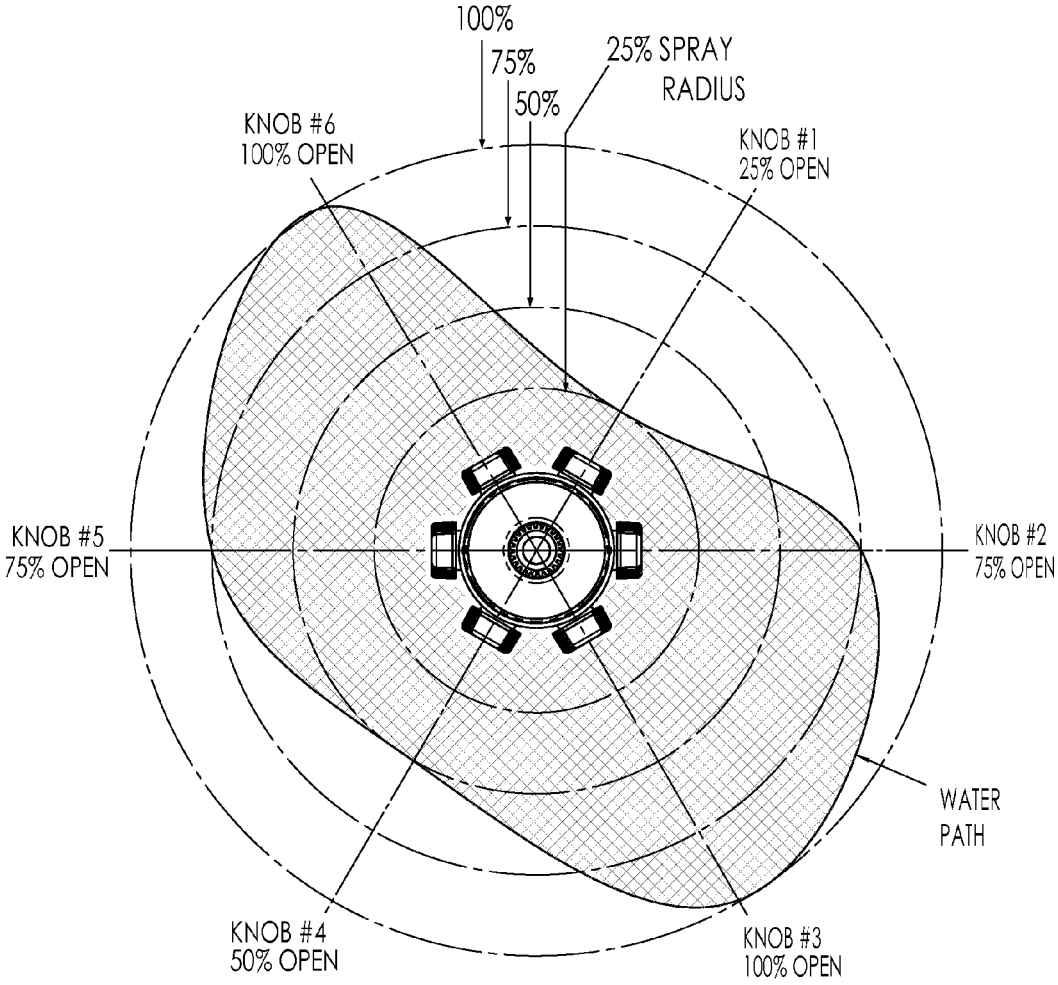
FIG. 7 illustrates one example of a spray pattern of the sprinkler shown in FIG. 1.
Figure 8D:
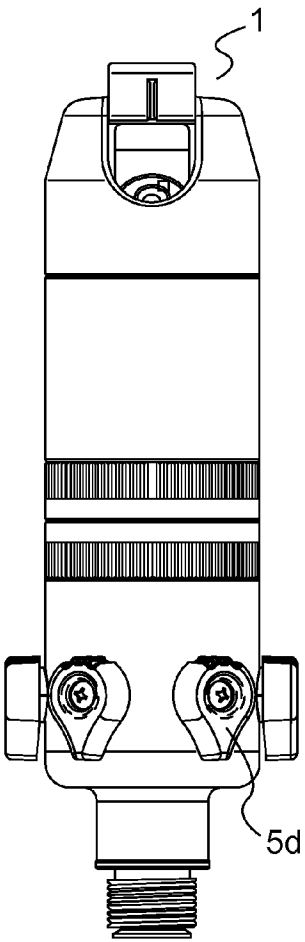
FIGS. 8*a-d* illustrates a first, second, third, and fourth embodiment of a ball valve adjustment unit.
Figure 8C:
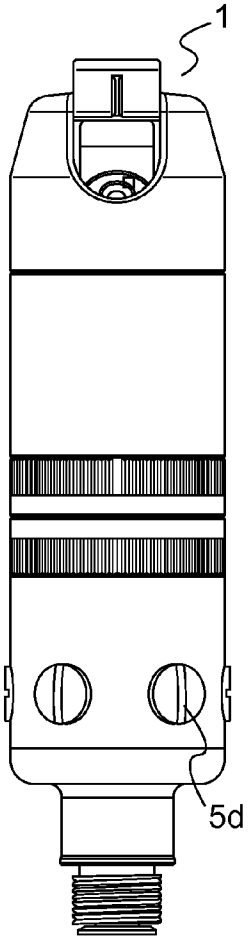
Figure 8B:
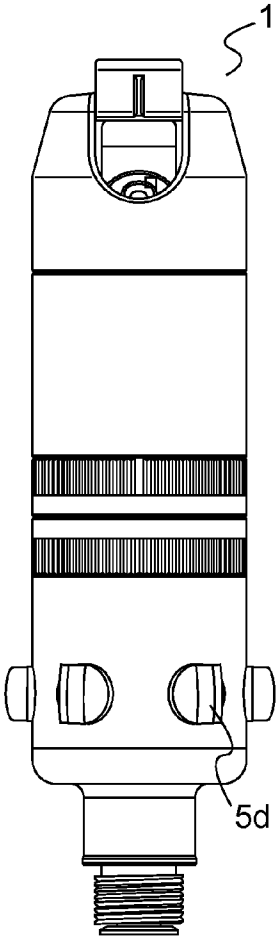
Figure 8A:
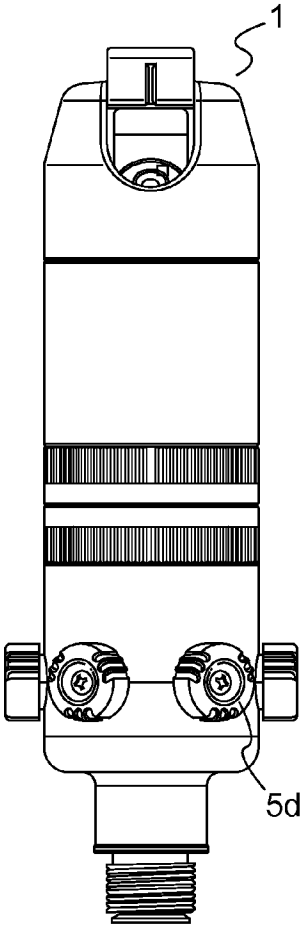
Figure 9C:
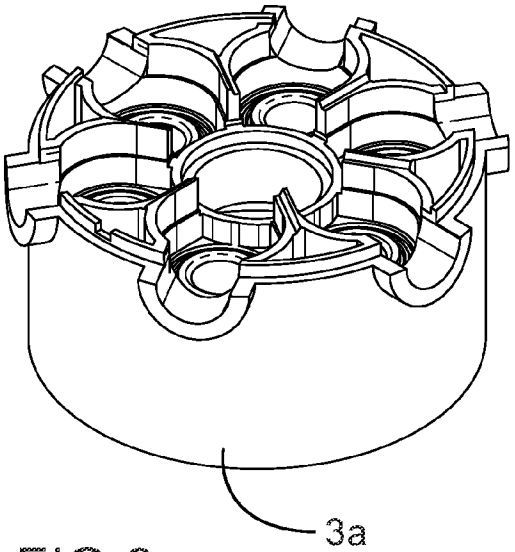
FIGS. 9*a-d* illustrates a bottom, side, perspective, and cross-section, respectively, of an upper bypass housing unit according to one embodiment.
Figure 9B:
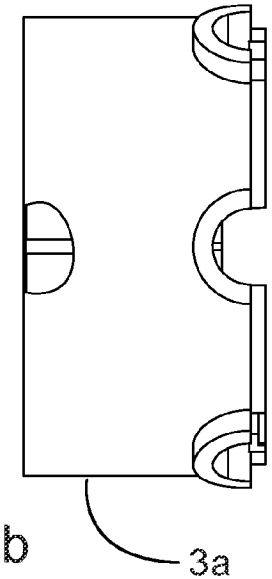
Figure 9A:
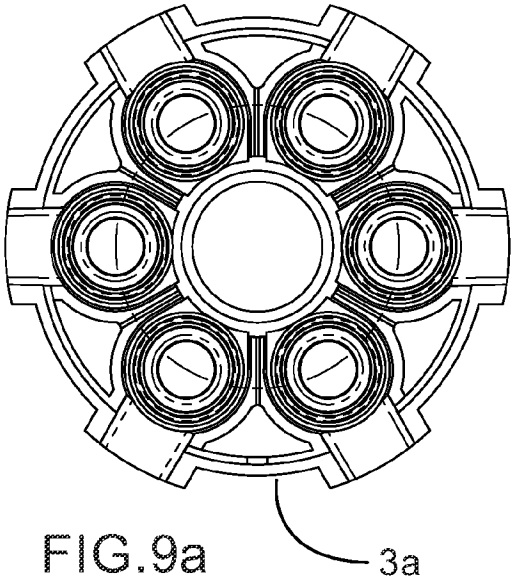
Figure 9D:
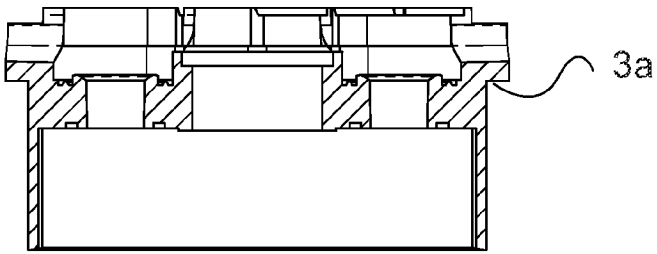
Figure 10C:
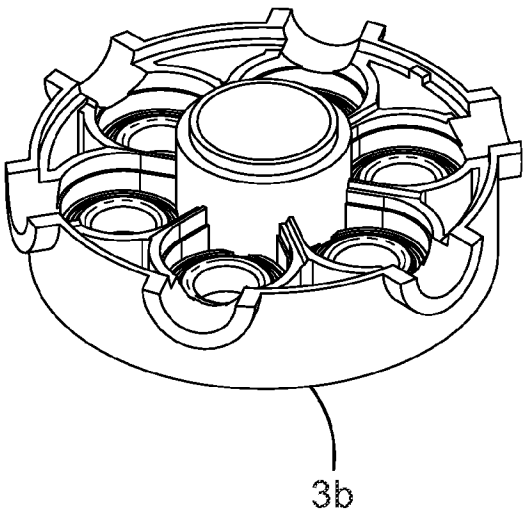
FIGS. 10*a-d* illustrates a bottom, side, perspective, and cross-section, respectively, of a lower bypass housing unit according to one embodiment.
Figure 10B:
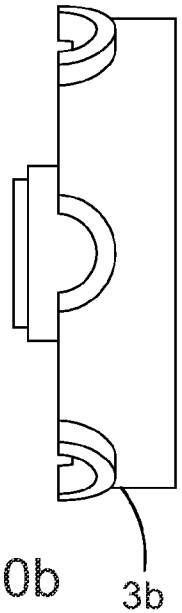
Figure 10A:
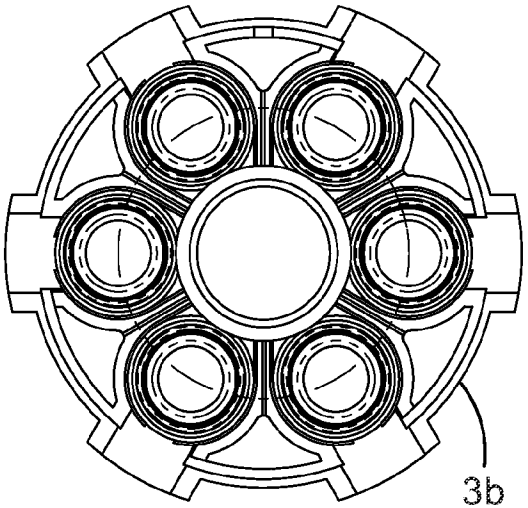
Figure 10D:
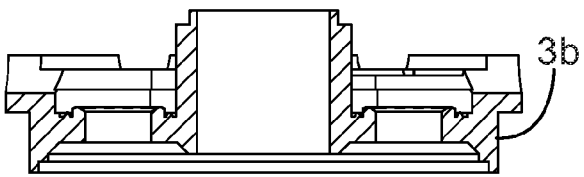

FIG. 7 illustrates one example of a variable range rotary sprinkler spray pattern simulation area. Apparatus 1 is designed to allow a user to customize the water path exiting the sprinkler 2. In this example, bypass unit 3 includes six adjustable ball valves assemblies 5 (i.e., knobs 1-6) and a user adjusts each of the six knobs 5*d* so the corresponding ball valves are opened 25%, 75%, 100%, 50%, 75%, and 100%, respectively. The user then turns on the water flow to the apparatus 1 so that water flows into the apparatus 1 in the manner described above and illustrated in FIG. 2. As a result, the outcome is the customized spray pattern shown in FIG. 7. In this embodiment, depending on the valve position, the water can spray, for example, from 20-40 feet. One advantage of customizing spray pattern is the ability to conserve water.

Figure 16A:
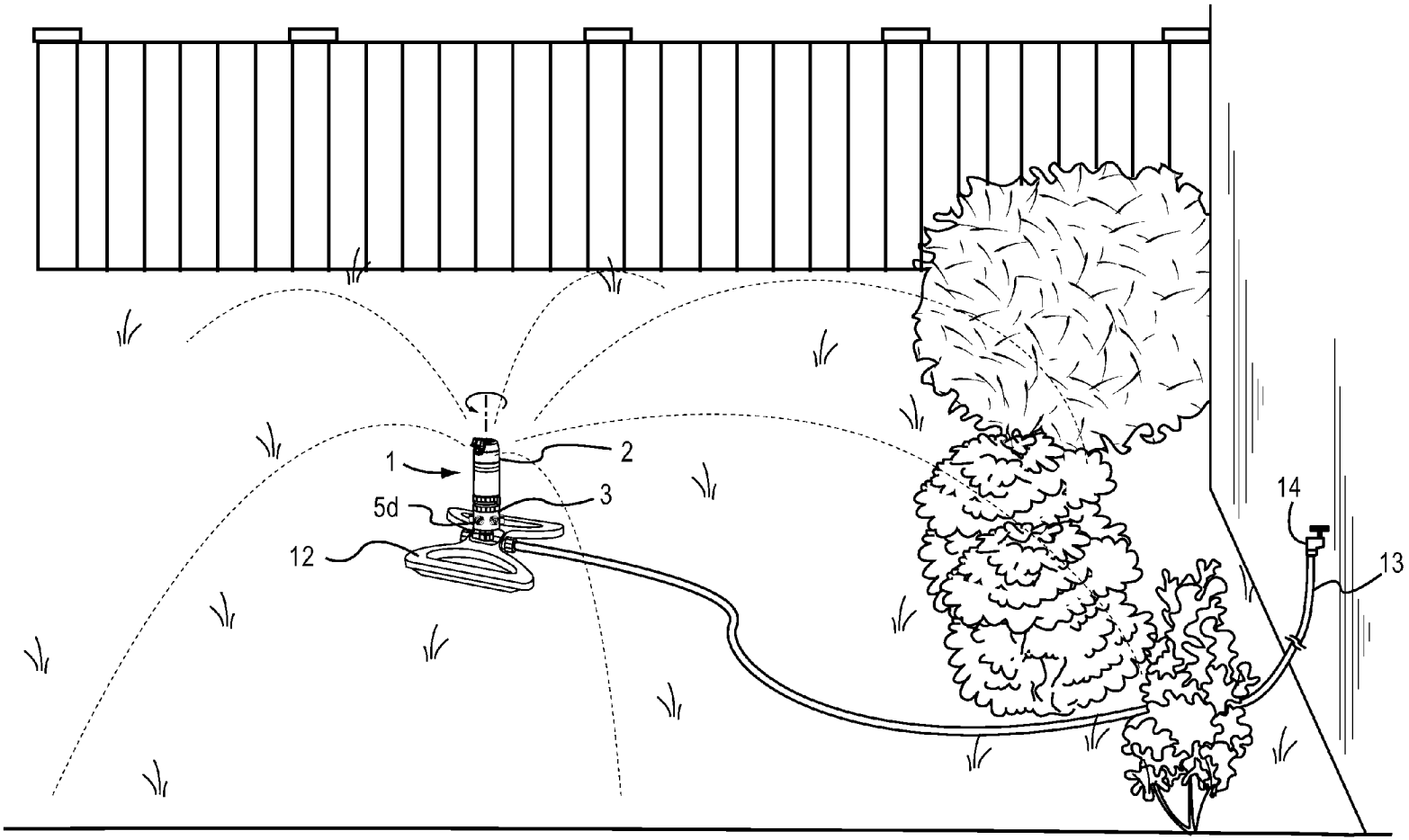
FIGS. 16*a-b* illustrates system views of an above-ground and below-ground embodiment of a variable range sprinkler apparatus, respectively
Figure 16B:
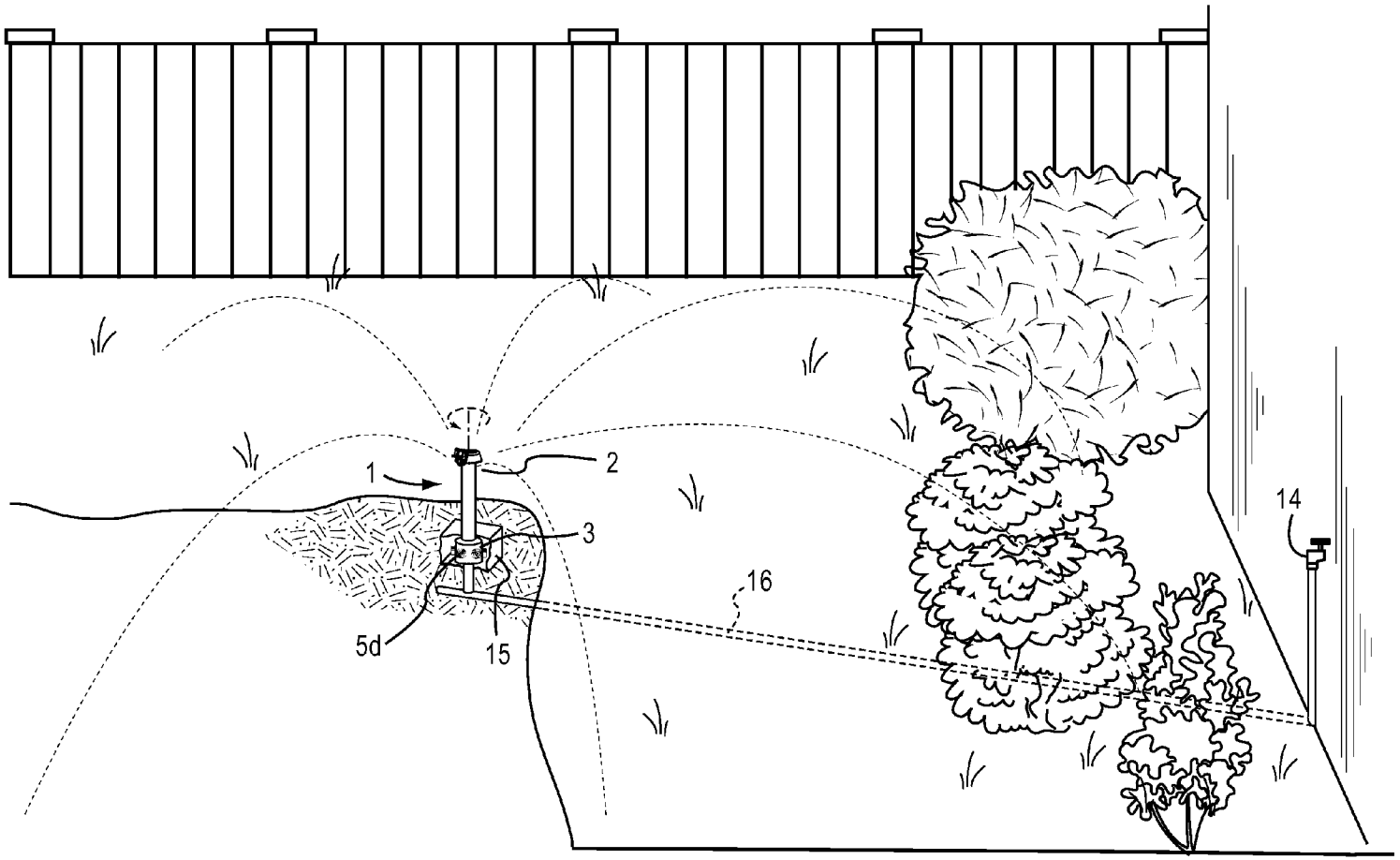

FIGS. 16*a* and 16*b* illustrate system views of an above-ground and below-ground embodiment of the variable range sprinkler apparatus 1, respectively.

In FIG. 16*a*, apparatus 1 includes a bypass unit 3, rotary sprinkler 2, and base 12. The base may be a flat base (such as included on Melnor Model No. 2960), a spike base (having one or more spikes penetrating into the ground), a telescoping base unit (as shown, for example, in U.S. application Ser. No. 12/181,867), or any other type of known base. A typical hose 13 connects the output of water source 14 (faucet) to an input of apparatus 1. Although not shown, the hose 13 may be attached to the water source 14 via a water timer device (not shown) that is operable with or without a water conservation device (such as the type shown in U.S. application Ser. No. 12/046,923 or U.S. application Ser. No. 12/046,944). In this embodiment, the base 12 is a flat base unit positioned on a surface of the lawn and the bypass unit 3 is positioned between the base unit 12 and the rotary sprinkler 2 of the apparatus 1. The user turns one or more of the knobs 5*d* of the bypass unit 3 a desired amount. The user then turns on the faucet 14 so that water flows through the hose 13 and into the apparatus 1 in the manner described above and illustrated in FIG. 2. As a result, the outcome is a spray pattern (e.g., such as shown in FIG. 7) designed by the user.

In FIG. 16*b*, apparatus 1 includes a bypass unit 3 attached to an underground pop-up rotary sprinkler 2, and housing 14 (which may or may not be included) designed to protect an underground portion of the apparatus 1. An underground pipe 16 connects the output of the water source 14 to an input of apparatus 1. Although not shown, a water timer device (not shown) may be connected to the pipe 16. Also, a water conservation device (not shown) may be added to the system. In this embodiment, the bypass unit 3 may be preset by the user (e.g., as described above in FIG. 7) before the apparatus 1 is inserted into a desired location in the ground. The housing 15 protects the bypass unit from the environment. In operation, the user turns on the faucet 14 so that water flows through the pipe 16 and into the apparatus 1 in the manner described above and illustrated in FIG. 2. As a result, the outcome is a spray pattern (e.g., such as shown in FIG. 7) designed by the user.

Although specific embodiments of the invention have been disclosed, it will be understood by those having skill in the art that changes can be made to those specific embodiments without departing from the spirit and the scope of the invention.

We claim:

1. A sprinkler apparatus comprising:
a sprinkler portion;
a bypass unit housing a plurality of ball valves; and
a water inlet portion, wherein
said sprinkler portion is rotatably attached to said bypass unit,
said bypass unit is coupled to said water inlet portion,
said plurality of ball valves is designed to open a water passage in said bypass unit,
at least one of said plurality of ball valves is independently adjustable, and
said water passage is a through-hole in said at least one of said plurality of ball valves that is disposed in an axial direction of said apparatus.

2. The sprinkler apparatus according to claim 1, further comprising:
a water outlet unit having an aperture formed in an approximate center portion thereof, and
a main axle extending downward from said sprinkler portion toward said water inlet portion of said apparatus, wherein
said aperture of said water outlet unit is adapted to receive said main axle, and
said water outlet unit is rotatable.

3. The sprinkler apparatus according to claim 1, said bypass unit comprising:
an upper bypass housing;
a lower bypass housing coupled to said upper bypass housing; and
a bypass base plate coupled to said lower bypass housing and said water inlet portion,
wherein said sprinkler portion is rotatably attached to said upper bypass housing.

4. The sprinkler apparatus according to claim 1, further comprising:
a plurality of valve chambers arranged in a ring-like fashion inside said bypass unit, wherein each of said chambers accommodates one of said plurality of ball valves.

5. The sprinkler apparatus according to claim 1, further comprising:
a fastener;
a valve adjustment unit coupled to at least one of said plurality of ball valves via said fastener; and
an aperture formed in an outside circumferential surface said bypass unit, wherein
said valve adjustment unit is located outside of said bypass unit, and
said aperture is designed to receive said fastener.

6. The sprinkler apparatus according to claim 1, wherein at least one of said plurality of ball valves is connected to a ball valve adjustment unit located outside of said bypass unit.

7. The sprinkler apparatus according to claim 2, said main axle comprising:
a hollow water inlet portion having a water inlet aperture communicating said hollow portion to an inside portion of said bypass unit,
a solid intermediate portion located above said inlet portion of said main axle, and
a hollow water outlet portion having a water outlet aperture communicating said hollow water outlet portion to said inside portion of said bypass unit, wherein
said intermediate portion is designed to redirect an incoming supply of water out of said water inlet aperture and into said bypass unit,
said water inlet aperture is located below said plurality of ball valves, and
said water outlet aperture is located above said plurality of ball valves.

8. The sprinkler apparatus according to claim 2, said rotatable water outlet unit comprising:
a top outlet unit having a first portion extending from a second portion thereof; and
a water outlet plate positioned inside said second portion of said top outlet unit , wherein
said first portion has a smaller outside diameter than said second portion,
said aperture extends through first portion, second portion, and said water outlet plate, and an outside diameter of said water outlet plate is substantially equal to an inside diameter of said second portion of said top outlet unit.

9. The sprinkler apparatus according to claim 8, said water outlet plate comprising:

a plate portion;

a protrusion extending upward from a top surface of said plate portion; and a cutout portion formed through said plate portion, wherein a height of said protrusion is substantially equal to a depth of said second portion of said top outlet unit, and said cutout portion aligns with at least one water passageway outlet of said ball valve as said water outlet unit rotates.

10. The sprinkler apparatus according to claim 8, wherein a width of said cutout portion is greater than or equal to a sum of A and B, wherein A is a diameter of said water passageway outlet, and B is a minimum distance between adjacent said water passageway outlets.

11. The sprinkler apparatus according to claim 9, said outlet plate further comprising:

a support ridge extending upward from said top surface of said plate portion.

12. The sprinkler apparatus according to claim 9, comprising:

a plurality of said protrusions spaced apart in a ring-like manner, wherein a passageway is defined by adjacent said protrusions, and said passageway is designed to communicate water from said bypass unit to said water outlet aperture of said main axle.

13. The sprinkler apparatus according to claim 2, further comprising:

a generally cylindrical sleeve located between an inside surface of said bypass unit and an outside surface of a large diameter portion of said water outlet unit, wherein said sleeve is a water seal for said water outlet unit and reduces friction generated between said rotating water unit and said bypass unit.

14. The sprinkler apparatus according to claim 13, wherein said sleeve is attached to an inside circumferential surface of said bypass unit.

15. The sprinkler apparatus according to claim 1, wherein said sprinkler portion is a rotary sprinkler unit.

16. The sprinkler apparatus according to claim 1, wherein said bypass unit comprises six valve chambers and each of said valve chambers accommodates one of said plurality of ball valves.

17. A unit for selectively bypassing water, comprising:

a housing a plurality of valve chambers positioned inside said housing; and a plurality of valve assembly units, wherein said plurality of valve chambers is arranged in a ring-like fashion, said valve assembly units are individually positioned inside said plurality of valve chambers, at least one of said valve assembly units is adjustable, at least one of said adjustable valve assembly units comprises a valve coupled to an adjustment unit, and said adjustment unit adjusts the position of said valve it is coupled to.

18. The unit for selectively bypassing water according to claim 17, wherein said valve is a ball valve and said adjustment unit is located outside of said housing and coupled to said ball valve via a fastener.

19. A method for adjusting water to flow through a sprinkler apparatus, comprising:

adjusting a first ball valve of said sprinkler apparatus to a first position;

adjusting a second ball valve of said sprinkler apparatus to a second position, wherein said first position influences a flow of said water exiting said sprinkler apparatus at a first time (T=1), said second position influences said flow of said water exiting said sprinkler apparatus at a second time (T=1+n), said first ball valve is adjusted independently from said second ball valve, and said first ball valve and said second ball valve are each disposed in an axial direction of said apparatus.

* * * * *